US006945431B2

(12) United States Patent
Miller

(10) Patent No.: US 6,945,431 B2
(45) Date of Patent: Sep. 20, 2005

(54) SANITIZABLE PISTON PUMPS AND DISPENSING SYSTEMS INCORPORATING THE SAME

(75) Inventor: William A. Miller, Buffalo Grove, IL (US)

(73) Assignee: Fluid Management, Inc., Wheeling, IL (US)

( * ) Notice: Subject to any disclaimer, the term of this patent is extended or adjusted under 35 U.S.C. 154(b) by 35 days.

(21) Appl. No.: 10/626,277

(22) Filed: Jul. 24, 2003

(65) Prior Publication Data

US 2005/0017024 A1 Jan. 27, 2005

(51) Int. Cl.[7] ..... B67D 5/60
(52) U.S. Cl. ..... 222/144; 222/388; 222/518
(58) Field of Search ..... 222/144, 383.1, 222/388, 518

(56) References Cited

U.S. PATENT DOCUMENTS

| | | | | |
|---|---|---|---|---|
| 1,987,748 A | * | 1/1935 | Norman et al. | 141/383 |
| 2,923,438 A | | 2/1960 | Logan et al. | |
| 3,074,597 A | | 1/1963 | Felts | |
| 4,258,759 A | * | 3/1981 | Achen | 141/100 |
| 4,259,372 A | | 3/1981 | Eddy | |
| 4,781,312 A | | 11/1988 | Strazdins | |
| 4,871,262 A | | 10/1989 | Krauss et al. | |
| 4,964,534 A | | 10/1990 | Strazdins | |
| 4,966,308 A | | 10/1990 | Strazdins | |
| 5,083,591 A | | 1/1992 | Edwards et al. | |
| 5,163,010 A | | 11/1992 | Klein et al. | |
| 5,240,502 A | | 8/1993 | Castaldo et al. | |
| 5,311,293 A | | 5/1994 | MacFarlane et al. | |
| 5,313,267 A | | 5/1994 | MacFarlane et al. | |
| 5,356,041 A | * | 10/1994 | Hellenberg et al. | 222/135 |
| 5,478,238 A | | 12/1995 | Gourtou et al. | |
| 5,495,338 A | | 2/1996 | Gouriou et al. | |

(Continued)

FOREIGN PATENT DOCUMENTS

| | | | |
|---|---|---|---|
| EP | 0992450 | A1 | 4/2000 |
| EP | 1090679 | A1 | 4/2001 |
| EP | 0800858 | B1 | 7/2002 |
| EP | 1134186 | B1 | 5/2003 |
| EP | 0788831 | B1 | 11/2003 |
| WO | WO-01-75586 | A1 | 10/2001 |
| WO | WO-03-026458 | A2 | 4/2003 |
| WO | WO 03/031161 | A1 | 4/2003 |
| WO | WO 03/031280 | A1 | 4/2003 |
| WO | WO 03/083334 | A1 | 10/2003 |

*Primary Examiner*—Joseph A. Kaufman
(74) *Attorney, Agent, or Firm*—Marshall, Gerstein & Borun LLP

(57) ABSTRACT

A sanitizable piston pump for dispensing ingredients of cosmetic preparations and other sanitary mixtures is shown and described. The pump includes a valve block including an inlet port threadably connected to a nipple which is detachably connected to an outlet port of a flexible package. The valve block further includes a piston port threadably connected to cylinder and an outlet port that sealably receives a valve stem. The inlet port, the outlet port and the piston port are in fluid communication with one another upon removal of the valve stem from the valve block. The valve stem includes an intake passage and an output passage. The cylinder slidably receives a piston. Both the piston and valve stem are connected to separate actuators. The actuator connected to the valve stem moves the valve stem into one of either an intake position for withdrawing fluid into the cylinder or a dispense position for pumping fluid out of the cylinder and out the outlet of the valve stem. A disposable plastic piston pump is also disclosed. Further, a lever mechanism for quickly and easily releasing a flexible package from the nipple connected to the valve block of the disclosed piston pumps is also shown and described.

28 Claims, 7 Drawing Sheets

U.S. PATENT DOCUMENTS 5,558,251 A * 9/1996 Neri ..... 222/135
5,622,692 A 4/1997 Rigg et al.
5,624,056 A 4/1997 Martindale
5,780,018 A 7/1998 Collins et al.
5,785,960 A 7/1998 Rigg et al.
5,797,750 A 8/1998 Gouriou et al.
5,855,626 A 1/1999 Wiegner et al.
5,862,947 A 1/1999 Wiegner et al.
5,903,465 A 5/1999 Brown
5,945,112 A 8/1999 Flynn et al.
5,992,691 A 11/1999 Post et al.
6,003,731 A 12/1999 Post et al.
6,024,250 A 2/2000 Hickey
6,067,504 A 5/2000 MacFarlane et al.
6,089,408 A 7/2000 Fox
6,164,497 A 12/2000 Chia et al.
6,177,093 B1 1/2001 Lombardi et al.
6,178,341 B1 1/2001 Macfarlane et al.
6,202,895 B1 3/2001 Fox
6,273,298 B1 8/2001 Post
6,284,228 B1 9/2001 Markowitz et al.
6,314,372 B1 11/2001 Macfarlane et al.
6,330,341 B1 12/2001 Macfarlane et al.
6,338,349 B1 1/2002 Robinson et al.
6,402,364 B1 6/2002 Esclar et al.
6,412,658 B1 7/2002 Bartholomew et al.
D461,080 S 8/2002 Bartholomew et al.
6,437,866 B1 8/2002 Flynn
D465,810 S 11/2002 Bartholomew et al.
6,478,235 B1 11/2002 Soderstrom et al.
6,502,583 B1 1/2003 Utsugi
6,510,366 B1 1/2003 Murray et al.
6,516,245 B1 2/2003 Dirksing et al.
6,571,003 B1 5/2003 Hillebrand et al.
6,615,881 B2 9/2003 Bartholomew et al.
6,622,064 B2 9/2003 Bartholomew et al.
D485,310 S 1/2004 Bartholomew et al.
6,672,341 B2 1/2004 Bartholomew et al.
2001/0047309 A1 11/2001 Bartholomew et al.
2002/0010528 A1 1/2002 Bartholomew et al.
2002/0081341 A1 6/2002 Sott
2002/0082745 A1 6/2002 Wilmott et al.
2002/0091596 A1 7/2002 Dudek et al.
2002/0095309 A1 7/2002 Rothschild
2002/0130442 A1 9/2002 Statham et al.
2002/0131985 A1 9/2002 Shana'a et al.
2002/0179639 A1 12/2002 Bartholomew et al.
2002/0194021 A1 12/2002 Matsumoto et al.
2003/0060925 A1 3/2003 Bartholomew et al.
2003/0062379 A1 4/2003 Bartholomew et al.
2003/0069667 A1 4/2003 Dirksing et al.
2003/0090176 A1 5/2003 Bartholomew et al.
2003/0120534 A1 6/2003 Glacchetti et al.
2003/0183654 A1 * 10/2003 Voskuil et al. ..... 222/144
2003/0230355 A1 12/2003 Bartholomew et al.

* cited by examiner

SANITIZABLE PISTON PUMPS AND DISPENSING SYSTEMS INCORPORATING THE SAME

TECHNICAL FIELD

Piston pumps for dispensing systems used in the preparation of sanitary products, such a cosmetics, are disclosed. More specifically, a piston pump that may be easily disassembled and sanitized and which can be incorporated into a complex dispensing system is disclosed. Further, a disposable plastic piston pump for use in such a complex dispensing system is also disclosed. Finally, improvements to dispensing systems that include multiple pumps dispensing multiple ingredients or components are disclosed which include improved mechanisms for removing or detaching flexible ingredient packages from piston pumps and improved drip catcher and container holders for small containers, such as small glass or plastic containers used to hold cosmetic products, are also disclosed.

DESCRIPTION OF THE RELATED ART

Multiple pump dispensing systems have been used in the paint industry. Specifically, such a dispensing system incorporating multiple pumps dispensing viscous fluids, such as paint colorant, from flexible packages is disclosed in U.S. Pat. No. 6,273,298, owned by the assignee of the present application. Typically, such systems include pumps mounted on a rotary turntable with each pump coupled to the flexible package containing a viscous fluid, such as a colorant. The table, with the pumps and packages mounted thereon, is rotated until the desired pump and package is disposed over the container to be filled. A control system is utilized to rotate the table and control the amount of material dispensed from the packages by the pumps. Linear type dispensing systems are also known.

However, such systems designed for non-sanitary products such as paint are not readily applicable to products that must be sanitary, such as cosmetics and foods. A suitable multiple component dispensing system in the cosmetics industry is therefore needed because there is an increasing demand for cosmetic preparations that are customized at the point of sale.

Specifically, a number of companies in the cosmetic industry have installed various apparatuses in retail stores for dispensing the various components of a cosmetic preparation in individual containers. Like the custom mixing of paint, the ingredients of the cosmetic preparation are dispensed based upon computer programs which utilize information relating to the customers skin color, oiliness and other properties that determine the proper color, texture, viscosity and other qualities of the customized product. The various ingredients are dispensed into a container and the container is then sealed, mixed and sold to the customer. Thus, the customized cosmetic product is formulated and prepared at the point of sale.

However, unlike the mixing of paint, cosmetic products are applied directly to a customer's skin and therefore a certain degree of sanitization is required. Thus, conventional piston pumps and conventional nutating pumps which have been used in the past for the formulation of paint, cannot be used in cosmetic application and other applications requiring a sanitary product because the pumps themselves are not designed to be frequently cleaned or sanitized. Simply put, the time and labor involved in cleaning or sanitizing conventional piston or nutating pumps would render the operation of a dispensing system used to prepare customized cosmetic products at a point of sale too expensive to be practical. Thus, new pump designs for sanitary applications, such as cosmetics, are needed.

Further, in multiple pump dispensing systems using ingredient packages that are flexible, the ingredient or component package is typically equipped with a female outlet port that is coupled to a nipple or male inlet port attached to the valve block of the pump. The connectors of self-sealing, meaning that when the male or nipple connector attached to the pump is inserted through the female connector attached to the package, a valve within the female connector is opened enabling the product to flow from the package to the pump. When the male and female connectors are separated, the valve in the female connector closes to prevent product waste or spillage and to further prevent undue amounts of air from entering the flexible package. These types of connectors are provided by Innovative Packaging Netherlands (IPN).

One problem associated with the use of these connectors is the force required to remove a package from a pump once the male-female connection is made. Employees or technicians operating a multiple dispensing system with flexible packages having these types of connectors often struggle to replace an empty package or simply change packages. Thus, modifications to existing dispensing systems are needed to facilitate the removal or changing of flexible packages using the male-female connector described above.

SUMMARY OF THE DISCLOSURE

In satisfaction of the aforenoted needs, an improved piston pump for dispensing ingredients of cosmetic preparations or other products requiring sanitized ingredients is disclosed. The disclosed pump may be easily disassembled for cleaning and sanitization. The pump is detachably connected to an outlet port of a flexible ingredient package. The pump comprises a valve block comprising an inlet port that is threadably connected to a nipple which, in turn, is detachably connected to the outlet port of the ingredient package. The valve block further comprises a piston port threadably connected to a cylinder and an outlet port that sealably and sealably receives a valve stem. The inlet port, outlet port, and piston port are in fluid communication with one another upon removal of the valve stem from the valve block.

The valve stem comprises an intake passage and an output passage. The cylinder slidably receives a piston. The cylinder comprises a distal end threadably connected to the piston port of the valve block and a proximal end. The valve stem is detachably connected to an actuator.

The actuator is capable of moving the valve stem to an intake position where the valve stem blocks the outlet port of the valve block and the valve block blocks the output passage of the valve stem. In the intake position, the intake passage of the valve stem provides communication between the nipple and the piston port thereby permitting flow from the package, through the nipple, through the intake passage of the valve stem, through the piston port and into the cylinder upon movement of the piston towards the proximal end of the cylinder, i.e., an intake stroke.

The actuator further is capable of moving the valve stem to a dispense position where the valve stem blocks the inlet port of the valve block and the valve block blocks the intake passage of the valve stem. In the dispense position, the output passage of the valve stem is in communication with the cylinder thereby permitting flow from the cylinder, through the output passage of the valve stem and out the valve stem upon movement of the piston towards the distal end of the cylinder, i.e., an output stroke.

Thus, the valve stem may be easily removed from the valve block and the cylinder may be easily removed from the valve block. Further, the piston may be easily removed from the cylinder and thereby the separated components may be easily cleaned and/or sanitized.

In a refinement, the proximal end of the cylinder is threadably connected to a lock nut which prevents the piston from exiting the proximal end of the cylinder.

In another refinement, the piston is connected to a distal end of a rod, which further comprises a proximal end that is threadably connected to a lock fastener. The lock fastener prevents the proximal end of the rod from entering the cylinder. The lock fastener also provides a surface or gripping element for an actuator to control movement of the piston.

In another refinement, the nipple connected to the valve block accommodates a check valve that permits flow from the package through the inlet port and not vice versa.

In yet another refinement, the valve block further comprises an intake passage and an output passage, both of which are disposed within the piston port. In the intake position, the valve stem blocks the output passage of the valve block and the valve block blocks the output passage of the valve stem. In the intake position, the intake passage of the valve stem is in alignment with the intake passage of the valve block thereby permitting flow from the package, through the nipple, through the intake passages of the valve stem and the valve block and into the cylinder upon movement of the piston towards the proximal end of the cylinder, i.e., an intake stroke.

In this refinement, in the dispense position, the valve stem blocks the intake passage of the valve block and the valve block blocks the intake passage of the valve stem.

In this dispense position, the output passage of the valve stem is in alignment with the output passage of the valve block thereby permitting flow from the cylinder, through the output passages of the valve block and the valve stem and out the valve stem upon movement of the piston towards the distal end of the cylinder, i.e., an output stroke.

In a refinement, the valve block is free of check valve. In another refinement, the valve stem is free of check valves. In yet another refinement, all components are capable of being sanitized.

An improved dispensing system is also disclosed which includes a plurality of pumps as described above, each connected to an ingredient package and all mounted on a moveable table to permit movement of each pump over the container to be filled. The actuators controlling the movement of the valve stems and the pistons as well as the movement of the table are all controlled by a programmable controller.

In another refinement, a push bar and lever system is provided which enables flexible packages to be easily dislodged from the nipples of the piston pumps. Specifically, each female outlet of each packages passes through a horizontal flange. This flange is engaged to a lever which can be pivotally mounted to the valve block or to some other structure of the dispense system. The lever is also connected to a vertical rod. Downward pressure on the vertical rod causes pivotal movement of the lever against the annular flange to dislodge the female connector associated with the package from the nipple or male connector associated with the pump. A quick and easy dislodgment is provided by this system.

Finally, a disposable piston pump is also disclosed. A disclosed disposable pump comprises a valve block comprising a nipple which is detachably connected to the outlet port of an ingredient package. The valve block further comprises a piston port connected to a cylinder and an outlet port. The valve block further comprises a check valve disposed in the nipple permitting flow from the package through the inlet port and not vice versa and the valve block also comprises a check valve disposed in the outlet port permitting flow from the cylinder through the outlet port and not vice versa. The valve block and nipple being fabricated from a single piece of injection molded plastic. The cylinder slidably receives a piston and a distal end of the cylinder is connected to the piston port of the valve block. The cylinder is also fabricated from a single piece of injected molded plastic and the piston is also fabricated from a single piece of injected molded plastic. Thus, disposable plastic piston pump is provided which consists of just three injected molded pieces—the valve block, the cylinder and the piston.

BRIEF DESCRIPTION OF THE DRAWINGS

The invention will be illustrated more or less diagrammatically in the accompanying drawings wherein.

Only certain embodiments have been set forth and alternative embodiments and various modifications will be apparent from the following description to those skilled in the art. These and other alternatives are considered equivalents and within the spirit and scope of this disclosure.

DETAILED DESCRIPTION OF THE PRESENTLY PREFERRED EMBODIMENTS

Figure 1:
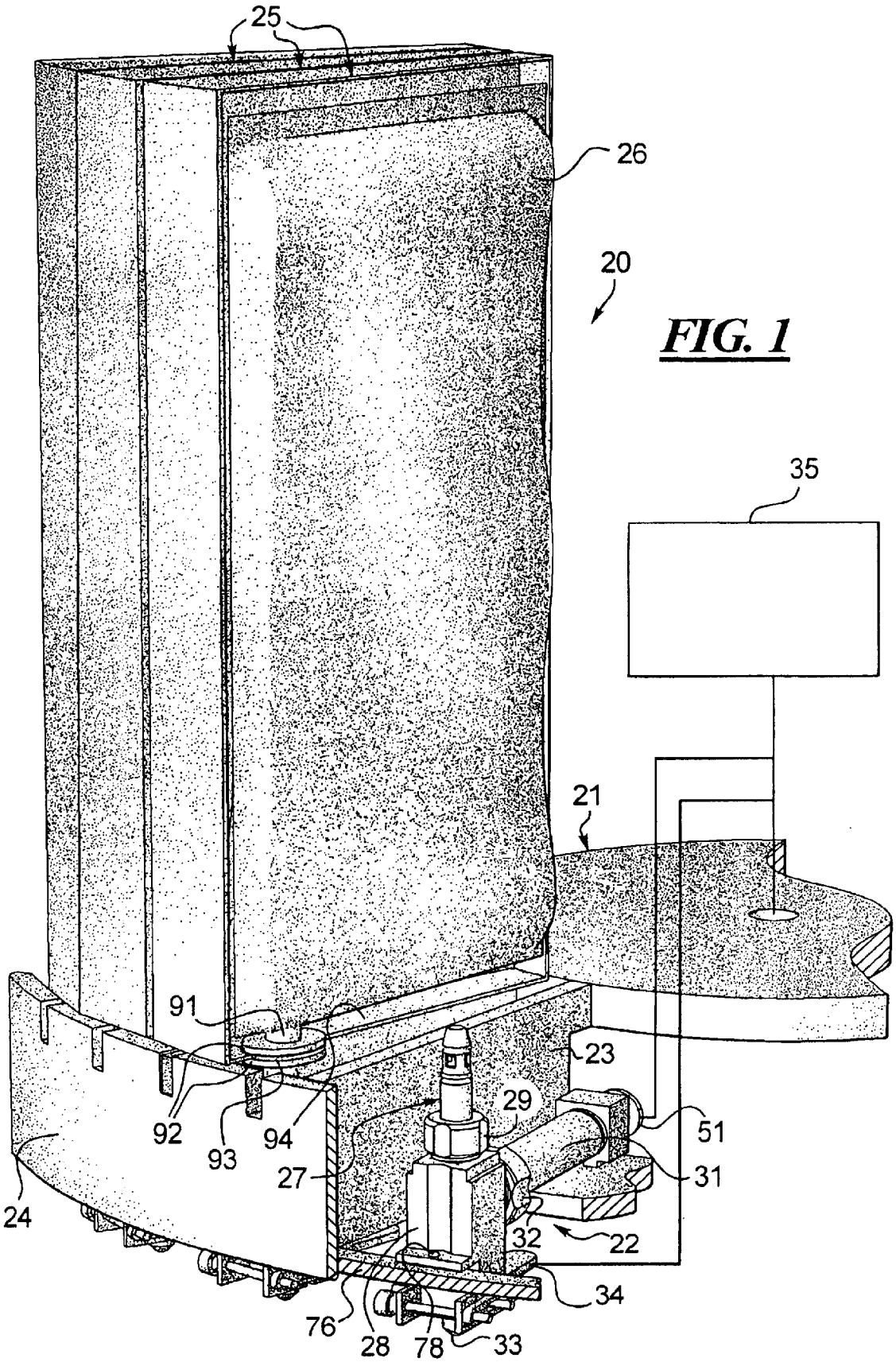
FIG. 1 is a partial perspective view of a multiple pumping dispensing system incorporating the sanitizable piston pump disclosed herein.

Turning to FIG. 1, a dispensing system 20 is disclosed which includes a rotary turntable 21 on which a plurality of pumps 22 are mounted. The pumps 22 are mounted between sectional walls shown at 23 and inside of a outer circumferential wall 24 which, in turn, support a plurality of frames 25 that support the flexible ingredient packages, one of which is shown at 26. The connection between each flexible package 26 and each pump 22 is made primarily by way of the nipple or inlet port 27 of the piston pump 22 which serves as a male connection and is received in a female outlet port (not shown) disposed in the flexible package 26. The nipple 27 is detachably connected to the valve block 28 by the threaded connection shown at 29.

Also connected to the valve block 28 is a cylinder 31 which slidably receives a piston (not shown). The cylinder 31 is also threadably connected to the valve block 28 by way of the threaded connector 32. A rod (not shown in FIG. 1) is connected to a piston (not shown in FIG. 1) that moves within the cylinder 31. The rod, in turn, is connected to an actuator element 32. Slidably received in the valve block 28 is a valve stem 33. Movement of the valve stem 33 within the valve block 28 is controlled by way of the actuator 34.

Rotational movement of the table 21, movement of the actuator 32 during input and output strokes and movement of the actuator 34 between intake and output positions can all be controlled by one or more controllers shown at 35. The individual components of the system 20 will now be described in greater detail in FIGS. 2–11.

Figure 2:
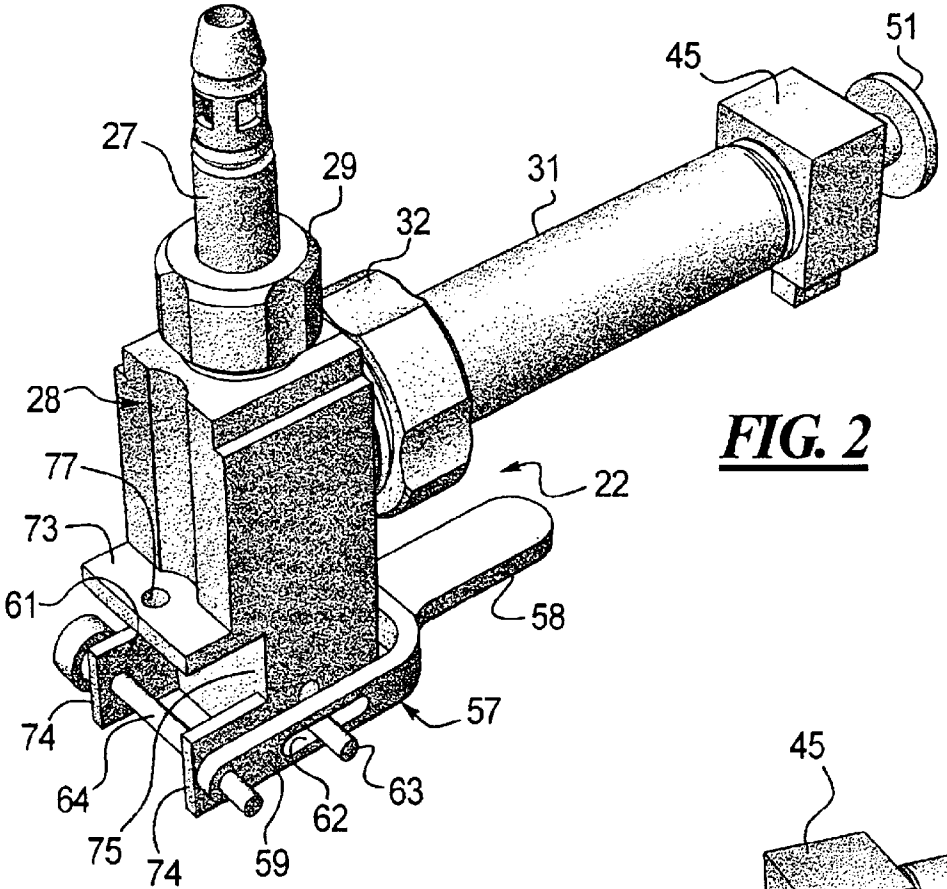
FIG. 2 is a left side perspective view of the sanitizable piston pump disclosed in FIG. 1.
Figure 3:
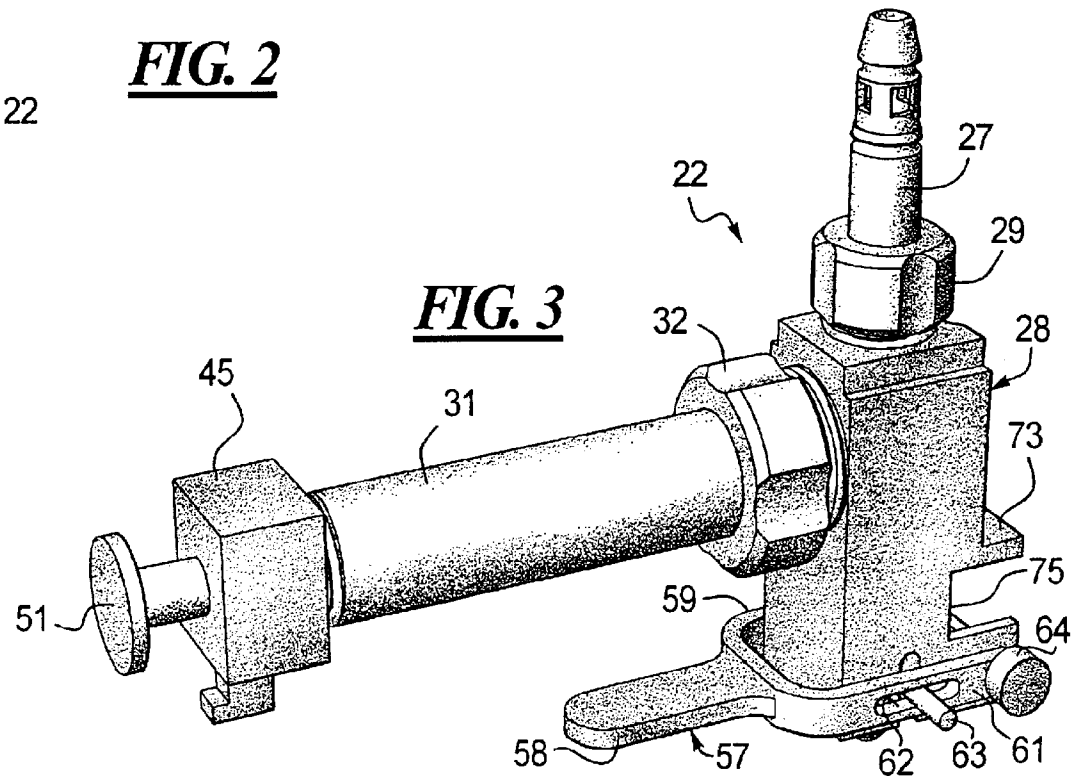
FIG. 3 is a right side perspective view of the sanitizable piston pump disclosed in FIG. 1.
Figure 4:
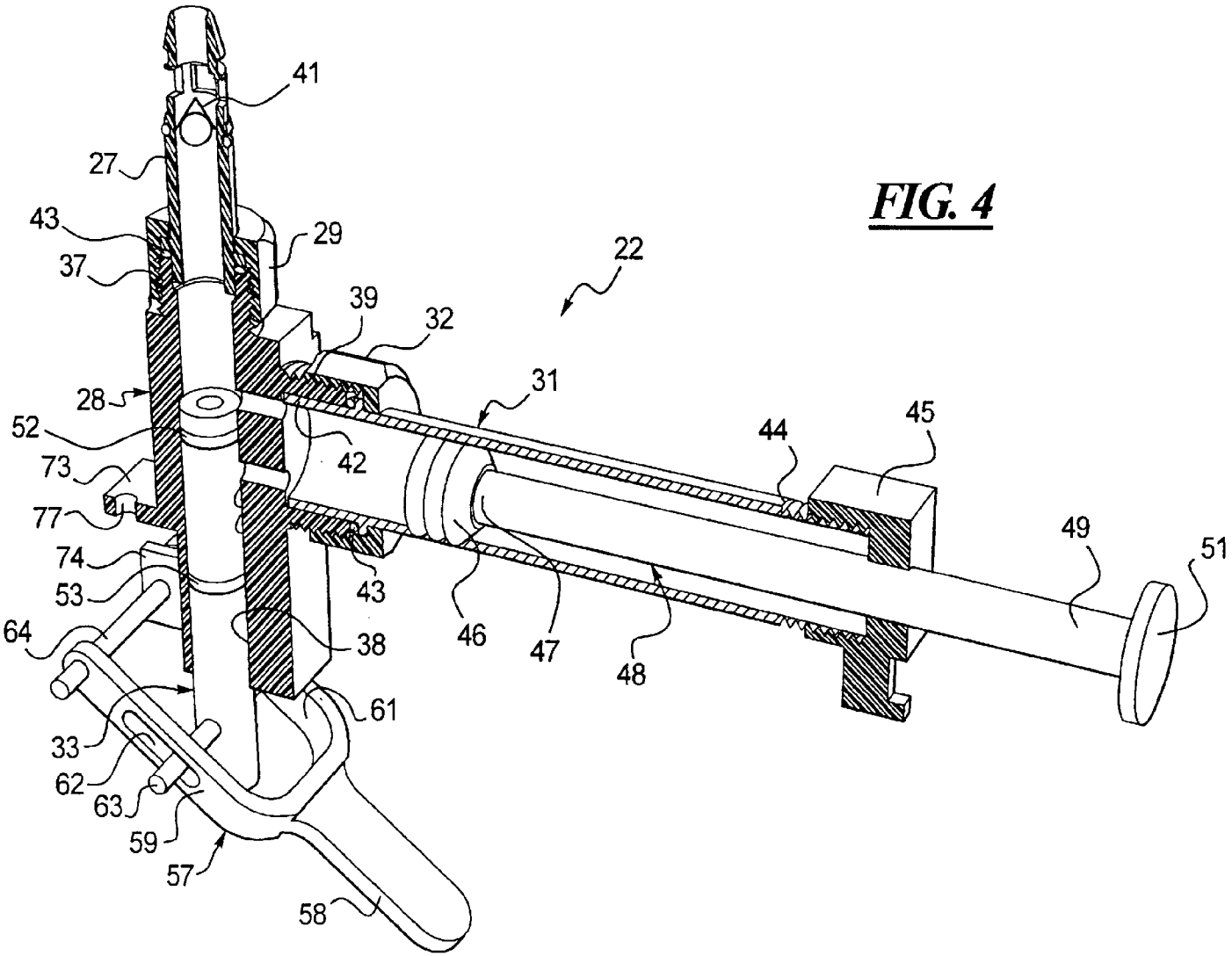
FIG. 4 is a sectional view the sanitizable piston pump disclosed in FIGS. 1–3.

Turning to FIGS. 2-4 the valve block 28 may be a unitary structure with a threaded inlet port 37, and outlet port 38 and a threaded piston port 39. The threaded inlet port 37 is detachably coupled to the nipple 27 by way of the threaded lock nut 29 as discussed above with reference to FIG. 1. The nipple 27 is detachably coupled to one of the flexible ingredient bags 26 (see FIG. 1) and preferably includes a 1-way check valve 41 for permitting ingredient flow from the flexible bag 26 downward through the nipple 27 and towards the valve stem 33 as shown in FIG. 4 and discussed in greater detail in FIG. 6 below.

The threaded piston port 39 is detachably coupled to the distal end 42 of the cylinder 31 by way of the threaded lock nut 32. 0-rings shown at 43 provide a seal between the valve block 28, the threaded couplers 29, 32 and the nipple 27 and cylinder 31 respectively. A proximal end 44 of the cylinder 31 is threadably coupled to another lock nut 45 which closes the proximal end 44 of the cylinder 31 and prevents the piston 46 from exiting the cylinder 31.

The piston 46 is connected to a distal end 47 of a rod 48 which also includes a proximal end 49 which, in turn, may be connected to a threaded fastener 51. The threaded fastener 51 provides a place for engagement by an actuator (not shown) which, in turn, is controlled by the controller 35 (see FIG. 1) during the intake and output strokes of the piston 46 as discussed in greater detail below with respect to FIGS. 6 and 7.

Figure 6:
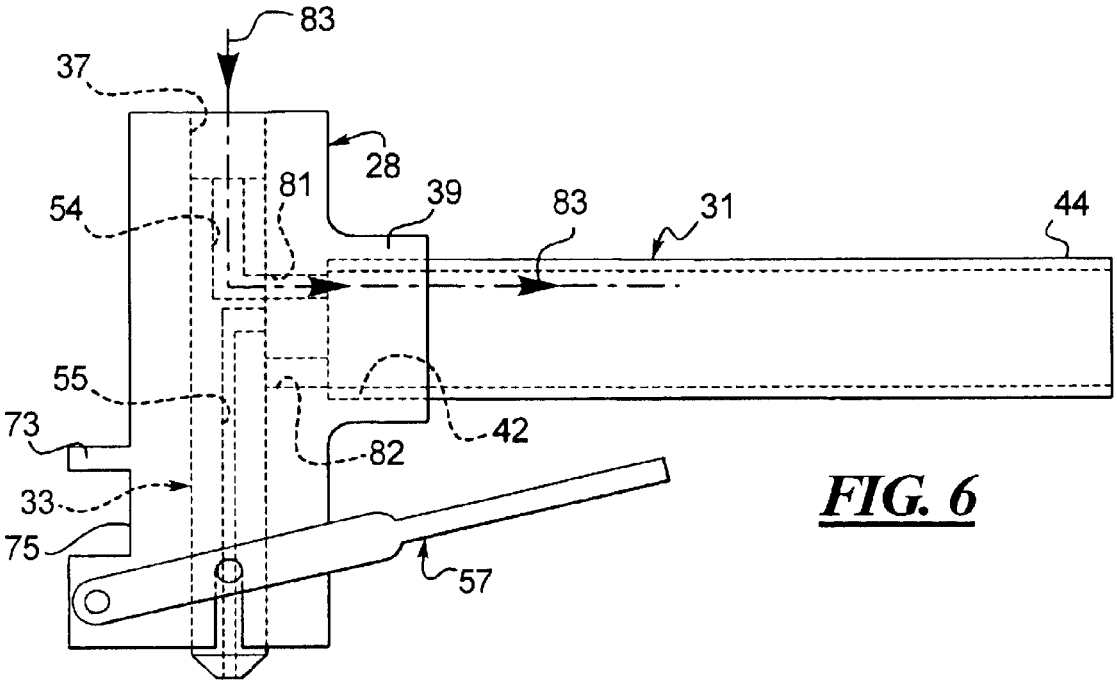
FIG. 6 illustrates, schematically, the fluid path and valve stem position of the sanitizable piston pump shown in FIG. 1, during an intake stroke.
Figure 7:
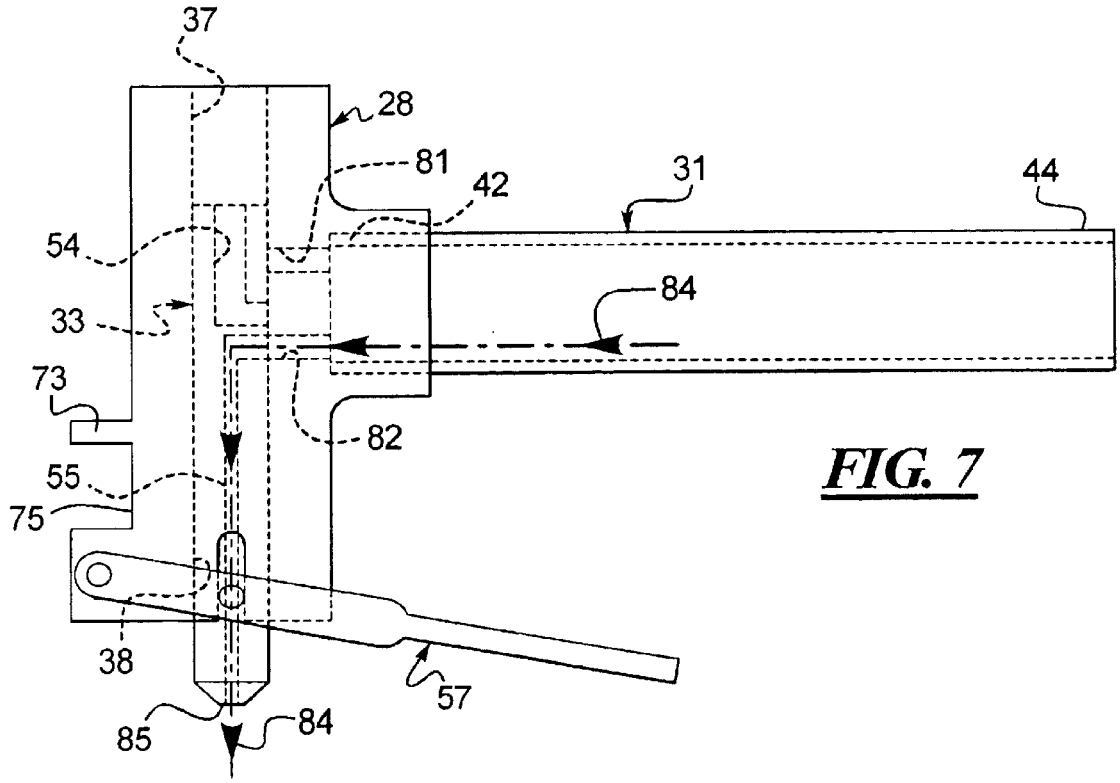
FIG. 7 illustrates, schematically, the fluid path of the sanitizable piston pump disclosed in FIG. 1, during an output stroke.

The outlet port 38 of the valve block 28 slideably receives the valve stem 33 and a seal between the valve stem 33 and the valve block 28 is provided by two 0-rings (not shown) accommodated in the grooves shown at 52, 53 in the valve stem 33. The valve stem 33, as shown in FIGS. 6–7, includes an intake passage 54 and an output passage 55. Movement of the valve stem 33 between the intake position shown in FIG. 6 and the outtake position shown in FIG. 7 is controlled by the actuator 57. In the embodiment shown in FIG. 4, the actuator 57 includes a handle 58 connected to fork legs 59, 61, each of which include a slot 62 for accommodating a pin 63 that passes through the valve stem 33. Similarly, the fork legs 59, 61 are connected to the valve block 28 by another pin 64.

Figure 5:
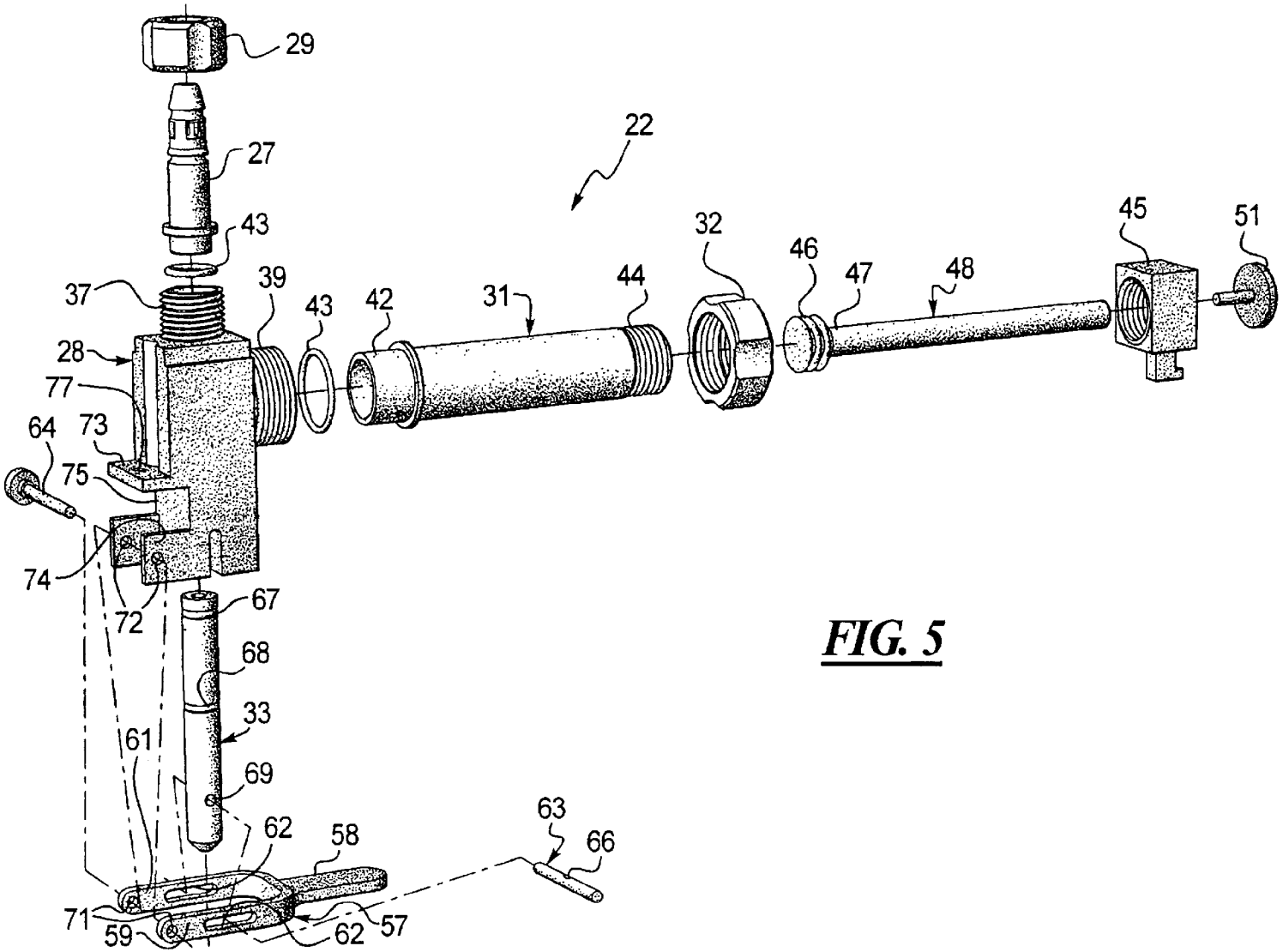
FIG. 5 is an exploded view of the sanitizable piston pump disclosed in FIGS. 1–4.

As shown in FIG. 5, the pin 63 that extends through the valve stem 33 also includes a hole or passage 66 for the passage of fluid out the output passage 55 of the valve stem 33. Also shown in FIG. 5 are the 0-rings 67, 68 disposed in the grooves 52, 53 respectively of the valve stem as shown in FIG. 4. Still referring to FIG. 5, the pin 63 passes through the transverse hole 69 of the valve stem 33. The actuator 57 also includes a pair of holes 71 for accommodating the pin 64 which also passes through a similar pair of hole 72 disposed in the valve block 28. The valve block 28 also includes a ledge 73 which, with the fins shown at 74 define as slot 75 for accommodating the wall 76 of the turntable 71 (see FIG. 1). A hole 77 and the ledge 73 provides a place for the passage of a fastener 78 (see also FIG. 1).

Turning to FIGS. 6–7, the piston port 39 of the valve block 28 also includes an intake passage 81 and an output passage 82. With the actuator 57 moved to an upper position as shown in FIG. 6, the valve stem 33 is moved to a point where the intake passage 54 of the valve stem 33 is in alignment with the intake passage 81 of the valve block 28. In the position shown in FIG. 6, fluid may flow from the flexible package 26 (see FIG. 1) down through the nipple 27 (see FIGS. 4–5) and into the input port 37 in the direction of the arrow 83. That is, when the piston 46 is moved in a proximal direction or in the direction of the arrow 83 while the valve stem 33 is in the position shown in FIG. 6, fluid flows from the flexible 26 into the cylinder 31 by way of the alignment of the intake passages 54 and 83.

Similarly, when the actuator 57 is moved to the down position shown in FIG. 7, the output passage 55 of the valve stem 33 is in alignment with the output passage 82 of the valve block 28. In this position, with the piston moving in a distal direction or in the direction of the arrow 84, fluid flows from the cylinder 31 through the output passages 82, 55 and out the outlet nozzle 85 as shown in FIG. 7. In the output position shown in FIG. 7, the intake passage 54 of the valve stem 33 is blocked by the valve block 28 and the intake passage 81 of the valve block 28 is blocked by valve stem 33. Conversely, in the input position or intake position shown in FIG. 6, the output passage 82 of the valve block 28 is blocked by the valve stem 33 and the output passage 55 of the valve stem 33 is similarly blocked by the valve block 28. Again, control of the actuator 57 is achieved by way of a conventional mechanism linked to the controller 35 (see FIG. 1).

Figure 8:
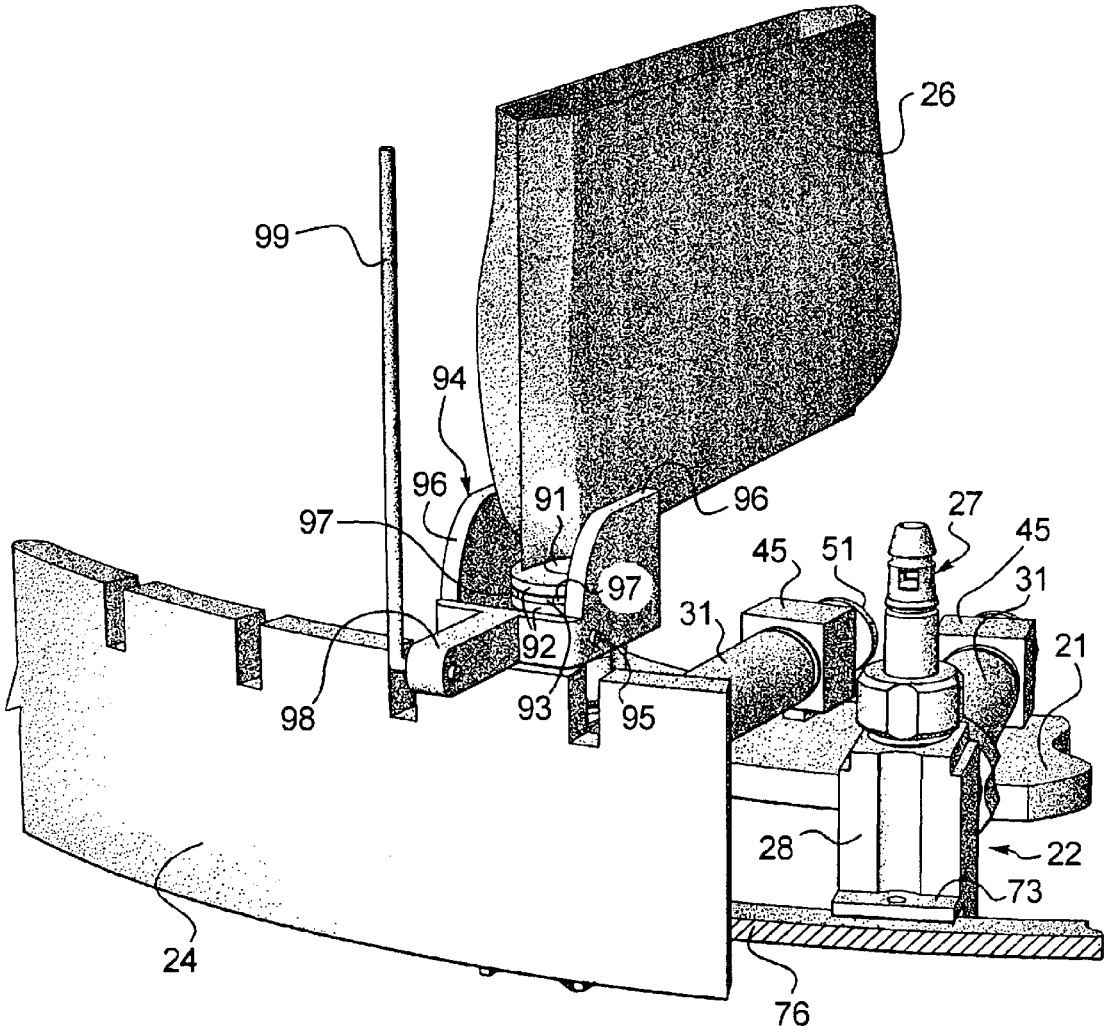
FIG. 8 is a partial perspective view of a multiple pump dispensing system similar to the one shown in FIG. 1 but including a mechanism to easily remove flexible packages from the piston pumps.

Turning to FIG. 8, an additional feature of the disclosed embodiment is illustrated. First, referring to FIG. 8, the outlet port 91 of the flexible bag 26 passes through a pair of opposing flanges shown at 92 in FIG. 8 and also in FIG. 1. In FIG. 1, the spaced-apart flanges define a slot 93 for receiving a lower wall 94 of the casing 25. In the embodiment shown in FIG. 8, the flanges 92 also provide a means for engagement by the lever shown at 94. The lever 94 may be connected to the table 21 or outer wall 24 in a conventional manner such as by the pin shown at 95.

The lever 94 includes a pair of spaced apart walls shown at 96. An inner surface of each wall 96 may include a lug or ledge shown at 97 that is received in the slot or gap 93 disposed between the flanges 92 and which provides an easy means for gripping or engaging the pair of flanges 92. An outwardly extending handle 98 of the lever 94 is connected to a rod shown at 99 in FIG. 8. Downward pressure applied to the rod 99 results in an upward pivotal movement of the lever 94 and an easy dislodgement of the bag 26 from a nipple 27. That is, by moving the rod 99 downward, the lever 94 and, specifically, the ledges or lugs shown at 97 sandwiched between the flanges 92 is pivoted upward about an axis defined by the pin 95 to snap the outlet 91 of the bag 26 off of a nipple 27 in an easy and convenient stroke.

Figure 9:
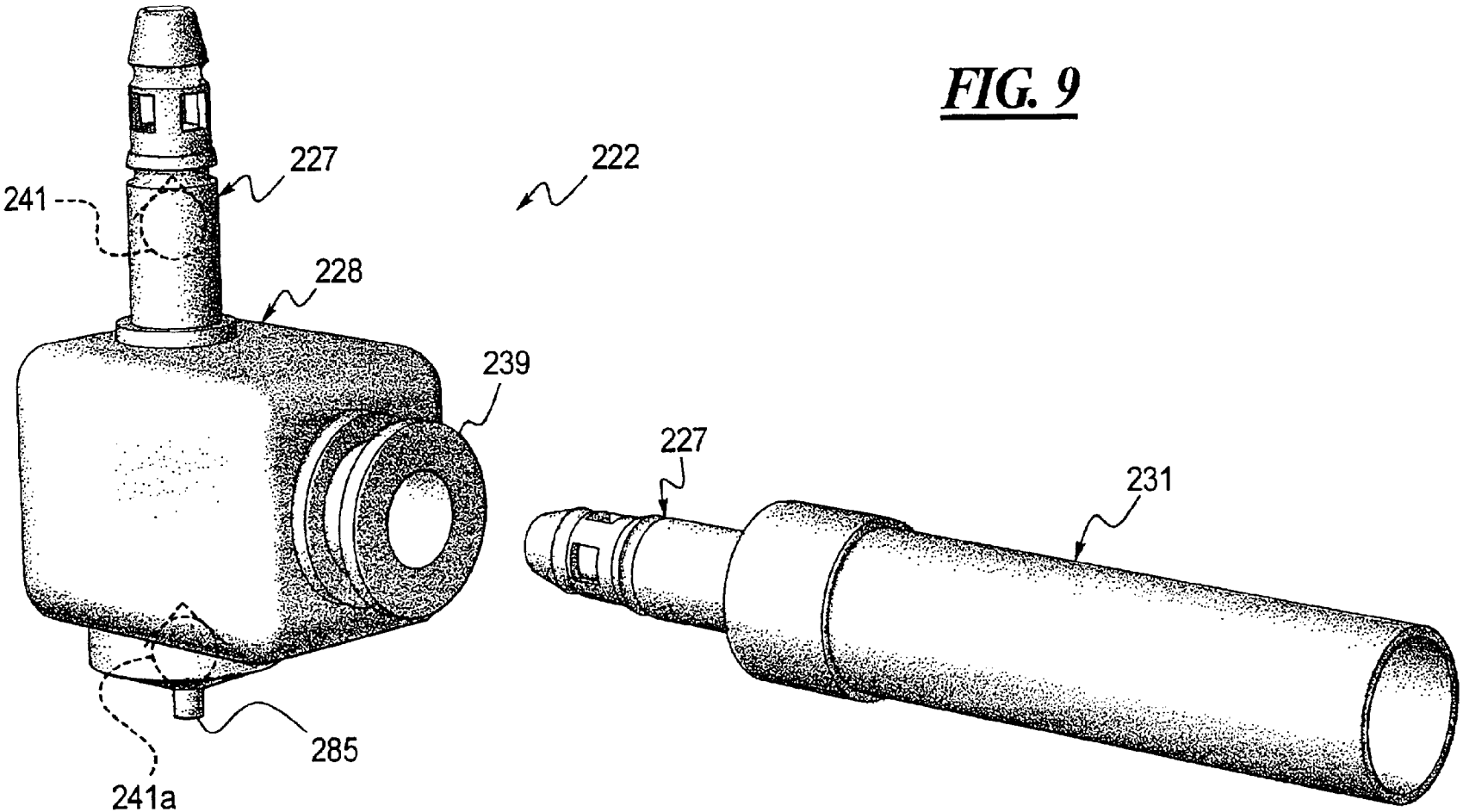
FIG. 9 is a partial perspective view illustrating the connection between the cylinder and valve block of the disposable piston pump as disclosed herein.

Finally, turning to FIG. 9 a disposable piston pump 222 is disclosed. The piston pump 222 includes a valve block 228 intrically molded to a nipple 227 equipped with a one-way check valve 241. The valve block 228 includes a female piston port 239 that mateably receives a nipple 227 intrically connected to the cylinder 231. An additional check valve 241*a* is disposed immediately above or within the outlet nozzle 285. The check valve 241*a* and nozzle 285 may be a single component or separate components. A piston similar to the one shown at 48 in FIGS. 1–4 is inserted into the cylinder 231. Upon an intake stroke, fluid proceeds from the bag 26 through the nipple 227, passes the one-way check valve 241 and into the cylinder 231. Upon movement of the piston (not shown) in an output direction, fluid flows from the cylinder 231, through the nipple 227, through the piston port 239, passed the one-valve check valve 241*a* and out the nozzle 285. The one-way check valve 241 prevents fluid from reentering the bag 26. Movement of the piston in an intake or input direction does not cause air to enter the valve block 228 due to the presence of the one-way check valve 241*a*. The valve block 228 and associated components shown in FIG. 9 can be injection molded. Similarly, the piston and integrated nipple 227 can also be injection molded. Finally, the piston (not shown in FIG. 9) may be one similar to that shown at 48 in FIG. 4 and may also be a molded product. With three relatively inexpensive components, a disposable piston pump 222 is provided which is cheap to manufacture and because of its low cost, can be discarded rather than cleaned or sanitized. In contrast, the more complicated pump illustrated in FIGS. 1–6 can be easily disassembled for cleaning and sanitization purposes.

While only certain embodiments have been set forth, alternative embodiments and various modifications will be apparent from the above description and drawings to those skilled in the art. These and other alternatives are considered equivalent and within the spirit and scope of the present disclosure.

What is claimed is:

1. A piston pump for dispensing ingredients of cosmetic preparations and that is easy disassembled for cleaning and sanitization purposes, the piston pump being detachably connected to an outlet port of a cosmetic ingredient package, the piston pump comprising:

a valve block comprising an inlet port threadably connected to a nipple which is detachably connected to the outlet port of the cosmetic ingredient package, the valve block further comprising a piston port threadably detachably connected to a cylinder and an outlet port that sealably receives a valve stem, the inlet port, outlet port and piston port being in fluid communication with one another upon removal of the valve stem from the valve block, the valve stem comprising an intake passage and an output passage, the cylinder slidably receiving a piston, the cylinder comprising a distal end threadably connected to the piston port of the valve block and a proximal end, the valve stem being detachably connected to an actuator, the actuator capable of moving the valve stem to an intake position where the valve stem blocks the outlet port of the valve block and the valve block blocks the output passage of the valve stem and intake passage of the valve stem provides communication between the nipple and the piston port thereby permitting flow from the package, through the nipple, through intake passage of the valve stem, through the piston port and into the cylinder upon movement of the piston towards the proximal end of the cylinder, the actuator further being capable of moving the valve stem to a dispense position where the valve stem blocks the inlet port of the valve block and the valve block blocks the intake passage of the valve stem and the output passage of the valve stem is in communication with the cylinder thereby permitting flow from the cylinder, through the output passage of the valve stem and out the valve stem upon movement of the piston towards the distal end of the cylinder.

2. The pump of claim 1 wherein the proximal end of the cylinder is threadably connected to a lock nut, the lock nut preventing the piston from exiting the proximal end of the cylinder.

3. The pump of claim 1 wherein the piston is connected to a distal end of a rod, the rod further comprising a proximal end that is threadably connected to a lock fastener, the lock fastener preventing the proximal end of the rod from entering the cylinder.

4. A cosmetics ingredient dispensing system comprising;

a plurality of piston pumps as defined by claim 3 with each pump being connected to a different ingredient package, each lock fastener being connected to an actuator, and the actuators connected to the lock fasteners and the actuators connected to the valve stems each being linked to a programmable controller, and the pumps all being mounted on a movable table to permit movement of each pump over a container to be filled with ingredients, the table being connected to a drive system which is linked to the controller, movement of the actuators and table being controlled by the controller.

5. The system of claim 4 wherein each outlet for each package extends through a horizontal flange, each pump being pivotally connected to a lever, each lever being connected to a vertical rod, wherein downward pressure on one of the rods results in upward pivotal movement of the lever against an underside of the flange to dislodge the outlet of the package from the nipple of its respective pump.

6. The pump of claim 1 wherein the nipple accommodates a check valve that permits flow from the package through the inlet port and not vice versa.

7. The pump of claim 1 wherein the valve block further comprising an intake passage and an output passage, the intake and output passages of the valve block being disposed within the piston port, in the intake position, the valve stem blocks the output passage of the valve block and the valve block blocks the output passage of the valve stem and the intake passage of the valve stem is in alignment with the intake passage of the valve block thereby permitting flow from the package, through the nipple, through intake passages of the valve stem and valve block and into the cylinder upon movement of the piston towards the proximal end of the cylinder, in the dispense position, the valve stem blocks the intake passage of the valve block and the valve block blocks the intake passage of the valve stem and the output passage of the valve stem is in alignment with the output passage of the valve block thereby permitting flow from the cylinder, through the output passages of the valve block and valve stem and out the valve stem upon movement of the piston towards the distal end of the cylinder.

8. The pump of claim 1 wherein the valve block is free of check valves.

9. The pump of claim 1 wherein the valve stem is free of check valves.

10. The pump of claim 1 wherein the valve block, valve stem, cylinder and piston are all capable of being sanitized.

11. A piston pump for dispensing ingredients of cosmetic preparations and that is easy disassembled for cleaning and sanitization purposes, the piston pump being detachably connected to an outlet port of a cosmetic ingredient package, the piston pump comprising:

a valve block comprising an inlet port threadably connected to a nipple which is detachably connected to the outlet port of the cosmetic ingredient package, the valve block further comprising a piston port threadably connected to a cylinder and an outlet port that sealably receives a valve stem, the valve block further comprising an intake passage and an output passage, the intake and output passages of the valve block being disposed within the piston port, the inlet port, outlet port, piston port and intake and output passages of the valve block being in fluid communication with one another upon removal of the valve stem from the valve block, the valve stem comprising an intake passage and an output passage, the cylinder slidably receiving a piston, the cylinder comprising a distal end threadably connected to the piston port of the valve block and a proximal end, the valve stem being detachably connected to an actuator, the actuator capable of moving the valve stem to an intake position where the valve stem blocks the output passage of the valve block and the valve block blocks the output passage of the valve stem and the intake passage of the valve stem is in alignment with the intake passage of the valve block thereby permitting flow from the package, through the nipple, through intake passages of the valve stem and valve block and into the cylinder upon movement of the piston towards the proximal end of the cylinder, the actuator further being capable of moving the valve stem to a dispense position where the valve stem blocks the intake passage of the valve block and the valve block blocks the intake passage of the valve stem and the output passage of the valve stem is in alignment with the output passage of the valve block thereby permitting flow from the cylinder, through the output passages of the valve block and valve stem and out the valve stem upon movement of the piston towards the distal end of the cylinder.

12. The pump of claim 11 wherein the proximal end of the cylinder is threadably connected to a lock nut, the lock nut preventing the piston from exiting the proximal end of the cylinder.

13. The pump of claim 11 wherein the piston is connected to a distal end of a rod, the rod further comprising a proximal end that is threadably connected to a lock fastener, the lock fastener preventing the proximal end of the rod from entering the cylinder.

14. The pump of claim 11 wherein the nipple accommodates a check valve that permits flow from the package through the inlet port and not vice versa.

15. The pump of claim 11 wherein the valve block is free of check valves.

16. The pump of claim 11 wherein the valve stem is free of check valves.

17. The pump of claim 11 wherein the valve block, valve stem, cylinder and piston are all capable of being sanitized.

18. A piston pump for dispensing ingredients of cosmetic preparations and that is easy disassembled for cleaning and sanitization purposes, the piston pump being detachably connected to an outlet port of a cosmetic ingredient package, the piston pump comprising:

a valve block comprising an inlet port detachably connected to a nipple which is detachably connected to the outlet port of the cosmetic ingredient package, the valve block further comprising a piston port detachably connected to a cylinder and further comprising an outlet port that sealably receives a valve stem, the valve stem comprising an intake passage and an output passage, the valve stem being detachably connected to an actuator, the actuator capable of moving the valve stem to an intake position where the valve stem blocks the outlet port of the valve block and the valve block blocks the output passage of the valve stem and intake passage of the valve stem provides communication between the nipple and the piston port thereby permitting flow from the package, through the nipple, through intake passage of the valve stem, through the piston port and into the cylinder, the actuator further being capable of moving the valve stem to a dispense position where the valve stem blocks the inlet port of the valve block and the valve block blocks the intake passage of the valve stem and the output passage of the valve stem is in communication with the cylinder.

19. The pump of claim 18 further comprising a piston that is connected to a distal end of a rod, the rod further comprising a proximal end that is threadably connected to a lock fastener, the lock fastener preventing the proximal end of the rod from entering the cylinder.

20. A cosmetics ingredient dispensing system comprising;

a plurality of piston pumps as defined by claim 19 with each pump being connected to a different ingredient package, each lock fastener being connected to an actuator, and the actuators connected to the lock fasteners and the actuators connected to the valve stems each being linked to a programmable controller, and the pumps all being mounted on a movable table to permit movement of each pump over a container to be filled with ingredients, the table being connected to a drive system which is linked to the controller, movement of the actuators and table being controlled by the controller.

21. The system of claim 20 wherein each outlet for each package extends through a horizontal flange, each pump being pivotally connected to a lever, each lever being connected to a vertical rod, wherein downward pressure on one of the rods results in upward pivotal movement of the lever against an underside of the flange to dislodge the outlet of the package from the nipple of its respective pump.

22. The system of claim 21 wherein at least some of the packages comprises a flexible bag.

23. The pump of claim 18 wherein the nipple accommodates a check valve that permits flow from the package through the inlet port and not vice versa.

24. The pump of claim 18 wherein the valve block further comprises an intake passage and an output passage, the intake and output passages of the valve block being disposed within the piston port, in the intake position, the valve stem blocks the output passage of the valve block and the valve block blocks the output passage of the valve stem and the intake passage of the valve stem is in alignment with the intake passage of the valve block thereby permitting flow from the package, through the nipple, through intake passages of the valve stem and valve block and into the cylinder, in the dispense position, the valve stem blocks the intake passage of the valve block and the valve block blocks the intake passage of the valve stem and the output passage of the valve stem is in alignment with the output passage of the valve block thereby permitting flow from the cylinder, through the output passages of the valve block and valve stem and out the valve stem.

25. The pump of claim 18 wherein the valve block is free of check valves.

26. The pump of claim 18 wherein the valve stem is free of check valves.

27. The pump of claim 18 wherein the valve block, valve stem, cylinder and piston are all capable of being sanitized.

28. The pump of claim 18 wherein the cosmetic ingredient package comprises a flexible bag.

* * * * *